US012246236B2

(12) United States Patent
Draeger

(10) Patent No.: US 12,246,236 B2
(45) Date of Patent: Mar. 11, 2025

(54) TRAINING AID WITH BODY/CLUB MOVEMENT/POSITION INDICATOR

(71) Applicant: Brian Draeger, Chicago, IL (US)

(72) Inventor: Brian Draeger, Chicago, IL (US)

( * ) Notice: Subject to any disclaimer, the term of this patent is extended or adjusted under 35 U.S.C. 154(b) by 504 days.

(21) Appl. No.: 17/692,457

(22) Filed: Mar. 11, 2022

(65) Prior Publication Data

US 2022/0305364 A1 Sep. 29, 2022

Related U.S. Application Data

(60) Provisional application No. 63/167,640, filed on Mar. 29, 2021.

(51) Int. Cl.
*A63B 69/36* (2006.01)
*A63B 71/06* (2006.01)

(52) U.S. Cl.
CPC .. *A63B 69/3621* (2020.08); *A63B 2071/0694* (2013.01)

(58) Field of Classification Search
CPC ..... A63B 69/3621; A63B 2071/0694
USPC ..... 473/215, 218, 219, 257, 266, 270–273, 473/278, 279
See application file for complete search history.

(56) References Cited

U.S. PATENT DOCUMENTS

| | | | | |
|---|---|---|---|---|
| 1,669,457 | A | 5/1928 | Dailey | |
| 2,180,170 | A * | 11/1939 | Richards | A63B 69/3667 473/272 |
| 3,384,377 | A * | 5/1968 | Stipp | A63B 69/3667 473/218 |
| 4,519,608 | A | 5/1985 | Gilly | |
| 5,482,284 | A * | 1/1996 | Vandever | A63B 69/3667 473/218 |
| 7,686,699 | B2 | 3/2010 | Snyders | |
| 8,157,665 | B2 | 4/2012 | Gibbs | |
| 8,562,451 | B2 | 10/2013 | Crabtree | |
| 9,908,025 | B2 | 3/2018 | Diz | |
| 9,956,467 | B2 * | 5/2018 | Vehslage | A63B 69/38 |
| 10,864,426 | B2 | 12/2020 | Watson | |
| 2008/0153615 | A1 | 6/2008 | Baird et al. | |
| 2011/0201438 | A1 | 8/2011 | Butts et al. | |
| 2013/0177886 | A1 | 7/2013 | McLaughlin | |
| 2016/0271474 | A1 * | 9/2016 | Draeger | A63B 69/0059 |

* cited by examiner

*Primary Examiner* — Nini F Legesse
(74) *Attorney, Agent, or Firm* — Crowell & Moring LLP

(57) ABSTRACT

A training aid is disclosed comprising a base; a first member rotatable with respect to the base about a first axis, wherein the base and the first member comprise respective indicia indicating a rotational position of the first member about the first axis; and a second member comprising: a proximal end coupled with the first member and rotatable about a second axis, wherein the first member and the second member comprise additional respective indicia to indicate a rotational position of the second member about the second axis; and a distal end configured to couple with a guide.

6 Claims, 17 Drawing Sheets

TRAINING AID WITH BODY/CLUB MOVEMENT/POSITION INDICATOR

CROSS-REFERENCE TO RELATED APPLICATION

This application claims the benefit of U.S. Provisional Patent Application No. 63/167,640, filed Mar. 29, 2021, which is hereby incorporated by reference herein.

BACKGROUND

Wearable golf swing training devices have been used to improve a golfer's golf swing. Some of these devices include a belt or other mechanism for securing the device to the golfer and a guide that projects from the device. The device can be positioned at the appropriate location on the golfer, such that the golfer's arm would contact the guide when the golfer is using an improper swing.

DETAILED DESCRIPTION

The following embodiments generally relate to a training aid with a body/club movement/position indicator. Some of these embodiments will be described below with reference to a golfer learning to improve his golf swing. However, it should be understood that these embodiments can be used in other environment as well, including, but not limited to, other sports or activities that involve a person positioning his body in a certain way and/or rotating or moving his body in a certain way (e.g., baseball, tennis, racquetball, squash, ping pong, swimming, volleyball, etc.).

Figure 1:
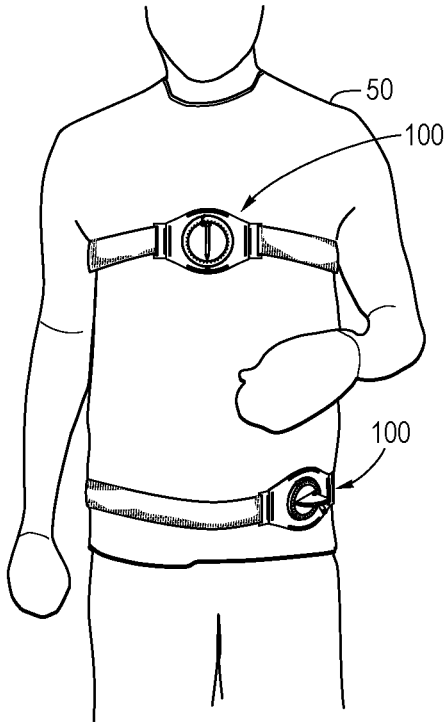
FIGS. 1-8 are illustrations of a golfer wearing a training aid of an embodiment.
Figure 2:
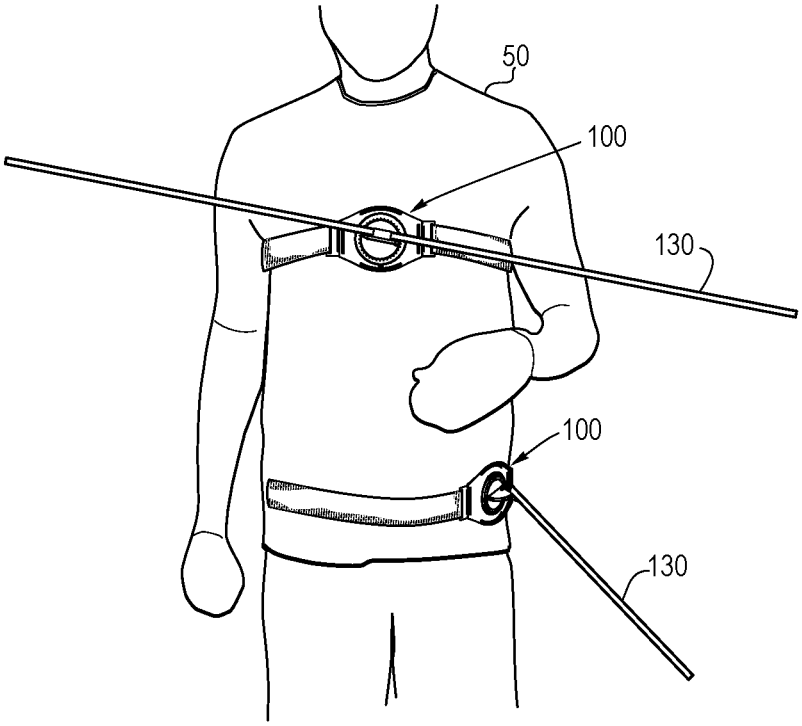
Figure 3:
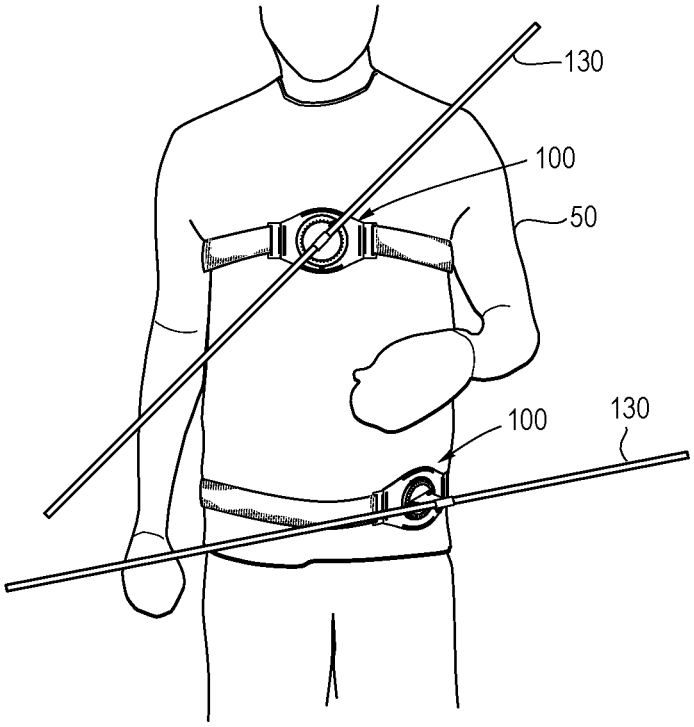
Figure 4:
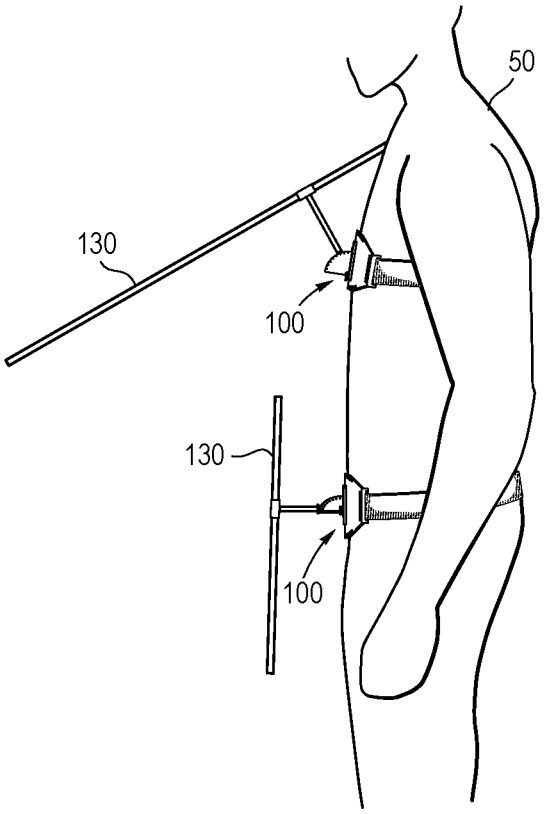

Turning now to the drawings, FIG. 1 is an illustration of a golfer 50 wearing two body position/movement training aids 100. In this example, one of the training aids 100 is attached to the golfer's waist, and the other training aid 100 is attached to the golfer's torso. It should be noted that any number of training aids 100 can be used, and the training aids 100 can be positioned at any desired location (e.g., bicep, forearm, wrist, thigh, calf, etc.) on the golfer 50 or on an item worn or carried by the golfer 50. As shown in FIG. 2 and as will be discussed in more detail below, in one embodiment, the training aids 100 allows a guide 130 to be attached to assist the golfer 50 in learning how to be positioned and rotate/swing in a certain way. A guide (which is sometimes referred to herein as a body movement indicator, rod, or shaft) can take any suitable form. For example, the guide 130 can be an alignment stick (see FIGS. 1-4) or a foam noodle (FIGS. 5-8). Other types of guides 130 can be used. In the embodiment shown in FIGS. 1-4, the training aid 100 allows the guide 130 to be moved along two different axes. Also, while the guide 130 is shown as being generally parallel to the training aid 100 in FIGS. 1-4 (here, the guide 130 is an alignment stick), in other embodiments, the guide 130 extends away from the training aid 100, as shown in FIGS. 5-8 (here, the guide 130 is a foam noodle).

Figure 5:
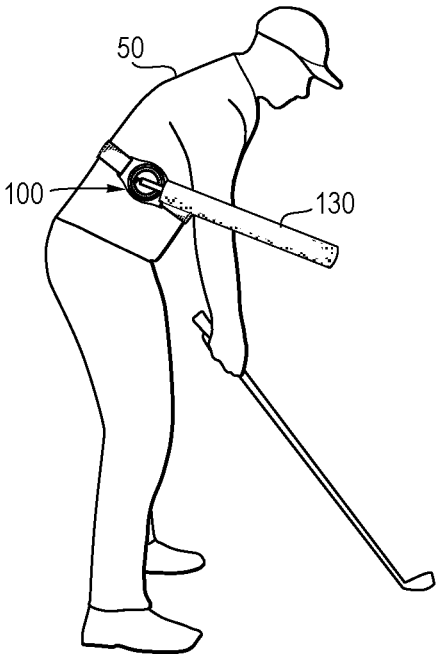

With reference to FIGS. 5-8, the training aid 100 and guide 130 can be used to assist in training the golfer 50 on the proper golf swing. FIG. 5 shows that the training aid 100 is positioned to the side of the golfer's ribcage, and the guide 130 (here, a foam noodle) is positioned to line-up with the trail elbow and is angled slightly (about 10 degrees) outward. This positioning can be used for a drill for players who struggle with maintaining a proper connection between the body and arms in the backswing. Lacking proper connection due to having a lack of core rotation can lead to many compensations and variables in the backswing. Having the appropriate core rotation provides a more-reliable source of power in addition to allowing the player to swing on plane due to proper hand depth while maintaining their arm structure.

Figure 6:
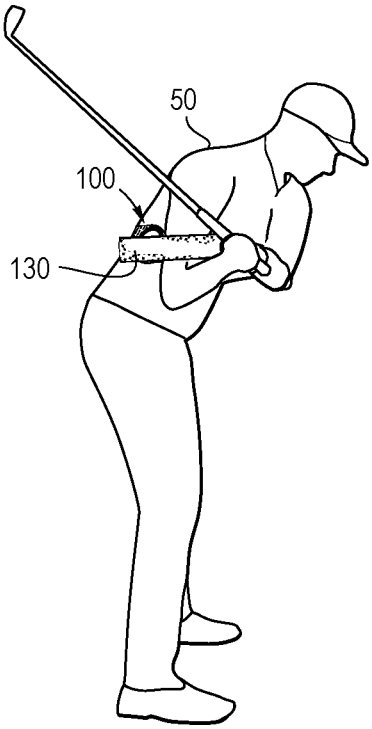
Figure 7:
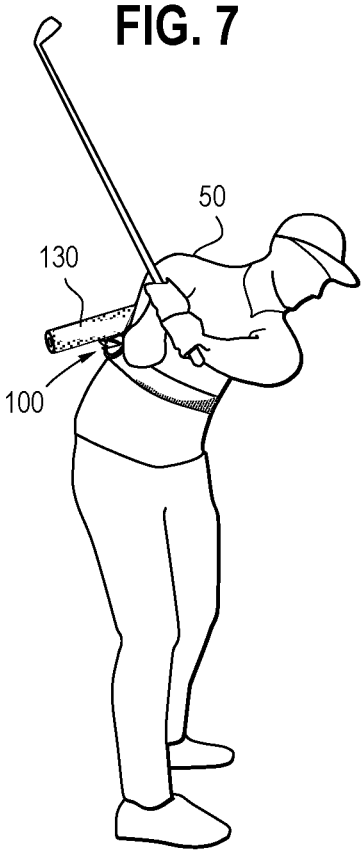
Figure 8:
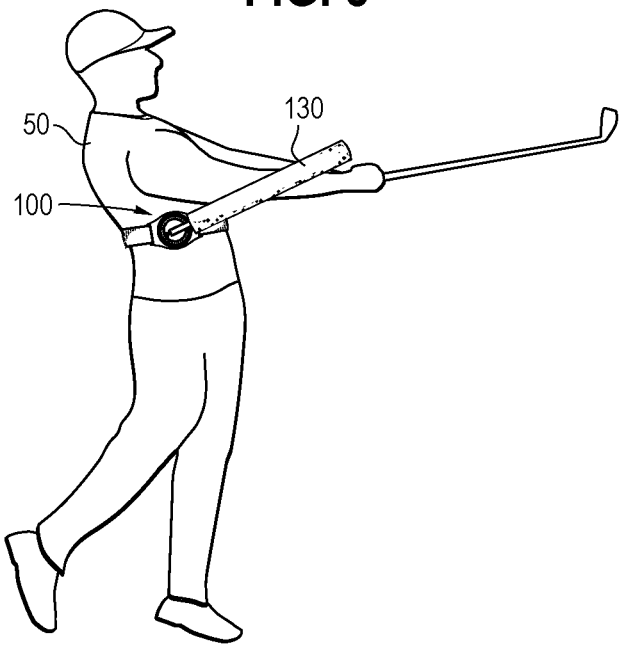

In FIG. 6, the golfer 50 swung the golf club with no core rotation. As a result, the golfer's lead arm works across his chest and is blocked by the guide 130. This contact provides the golfer 50 with swing feedback, informing him that he is doing something wrong and needs to make an adjustment. In contrast, in FIG. 7, the golfer 50 swung the golf club with proper core rotation, which allowed the golfer's arms to work away and up in the backswing without getting blocked by the guide 130. Further, as shown in FIG. 8, the golfer 50 is able to see that the guide 130 is in the proper position after the golfer 50 hits the golf ball. So, as illustrated by this example, a properly-positioned guide 130 can provide physical feedback and/or visual feedback.

Prior training aids are often positioned on the golfer by an instructor to ensure the training aid and guide are in the proper position for the drill. The instructor usually uses the same training aid for multiple students and needs to calibrate the position of the guide differently for each student depending on the student's body and what part of the swing needs attention. As a result, when a given student returns for his next lesson, the instructor needs to spend time positioning the guide in the correct position again. With prior training aids, this can be a time-consuming and tedious trial-and-error process. However, the training aid of these embodiments can be used to avoid these difficulties.

In one example embodiment, a training aid provides a 360-degree rotatable/quick-release-locking base in conjunction with a 90-degree lockable pivot, each with indicia to indicate the two rotational positions. That way, when an instructor positions first and second members of the training aid in the proper positions, the instructor can make note of the horizontal and vertical rotational positions. At the next lesson, the instructor can simple "dial in" the noted horizontal and vertical rotational positions rather than "reinvent the wheel" by determining the proper position for the golfer.

Figure 9:
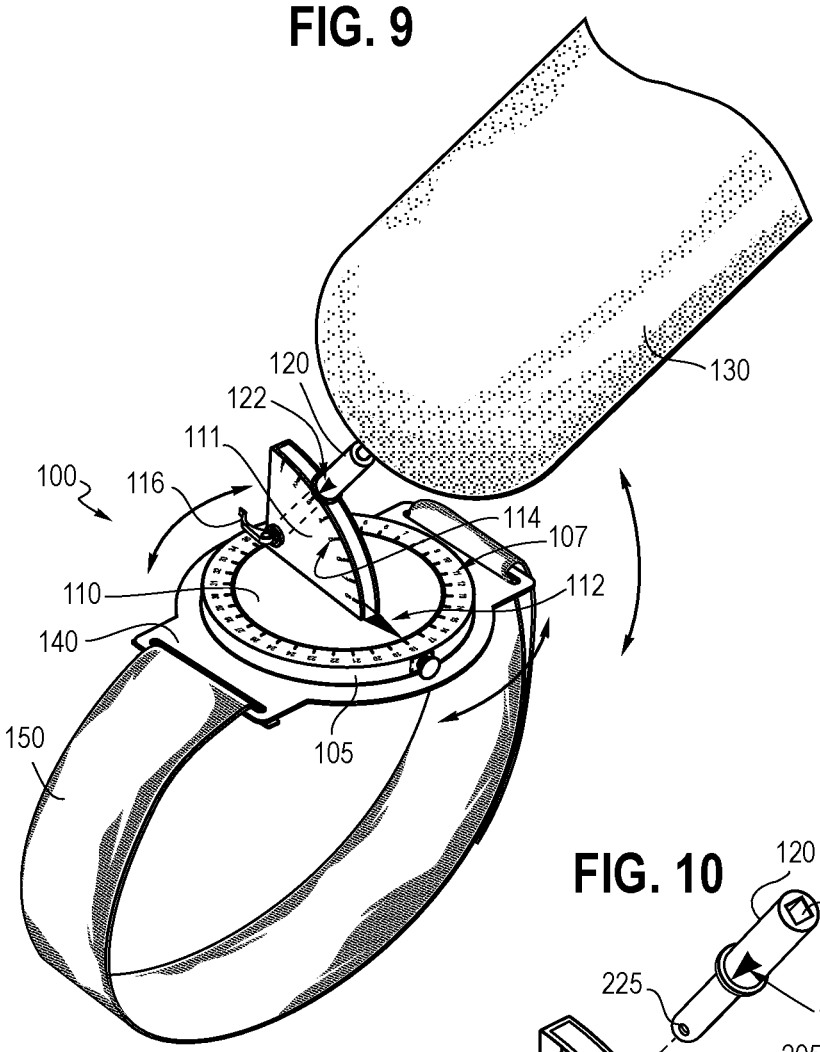
FIG. 9 is an illustration of a training aid of an embodiment.

Returning to the drawings, FIG. 9 shows a training aid 100 of one embodiment in more detail. As shown in FIG. 9, the training aid 100 in this embodiment comprises a base 105 that is integrated with or removably attached to a mount 140, which has openings through which a band/securing straps 150 pass to secure the training aid 100 to the body of a golfer. The training aid 100 also comprises a first member 110 and a second member 120.

The first member 110 is rotatable with respect to the base 105 about a first axis through the center of the first member 110. In this embodiment, the first member 110 is fully rotatable (360 degrees) about the first axis; however, in other embodiments, a more-limited range of rotation can be used. The base 105 and the first member 110 comprise respective indicia 107, 112 that indicates a rotational position of the first member 110 about the first axis. The indicia can take any suitable form. In this example, the indicia 107 on the base 105 serves as a horizontal rotational indicator and includes lines with numbers that indicate a rotational position (here, 0 to 35 degrees), and the indicia 112 on the first member 110 comprises an arrow that points to one of the lines. Of course, this is just one example, and other types of indicia can be used. The first member 110 also comprises a vertical portion 111 that is generally perpendicular to the portion of the first member 110 that fits within the base 105.

Figure 10:
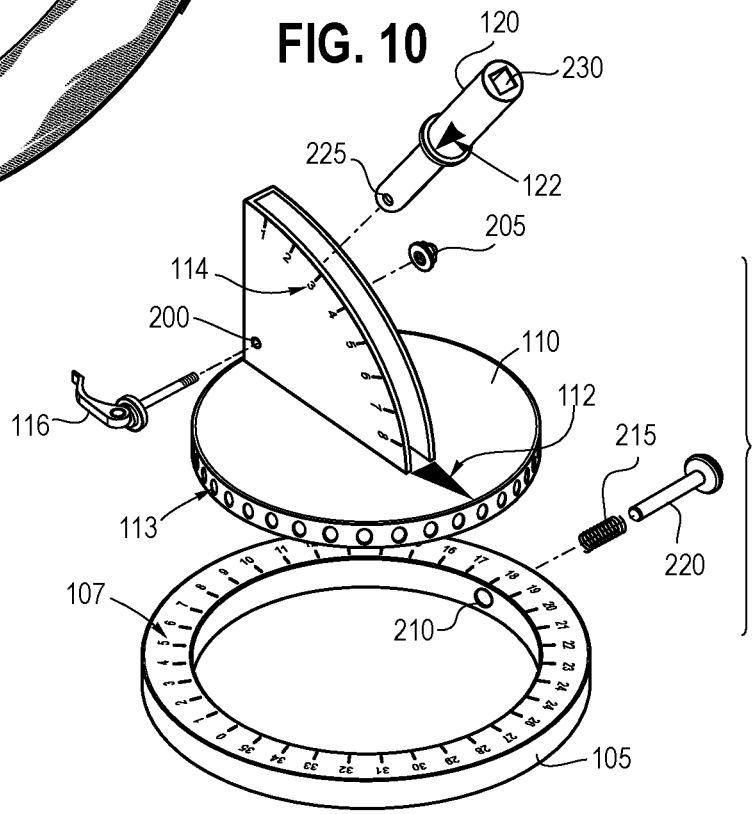
FIG. 10 is an exploded view of a training aid of an embodiment.
Figure 11:
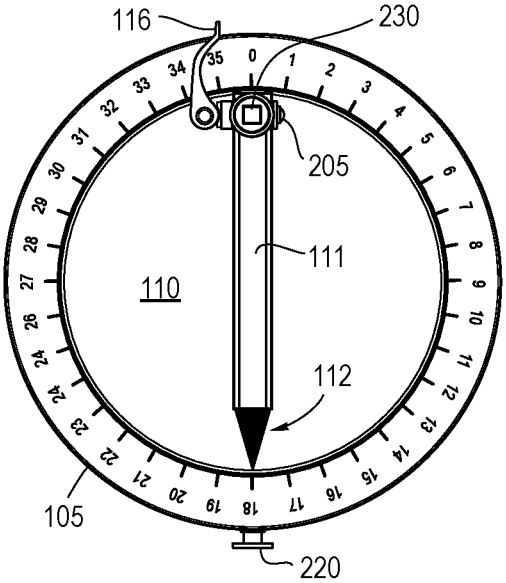
FIG. 11 is a top view of a training aid of an embodiment.
Figure 12:
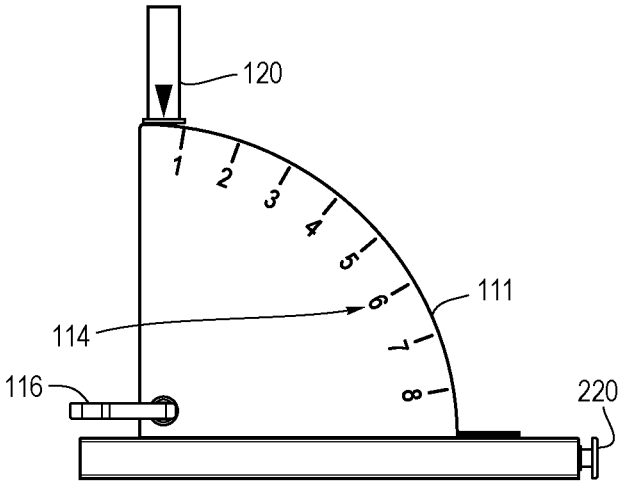
FIGS. 12-13 are illustrations of side views of a training aid of an embodiment.
Figure 13:
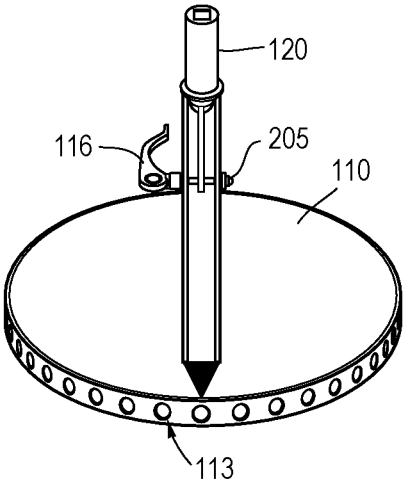
Figure 14:
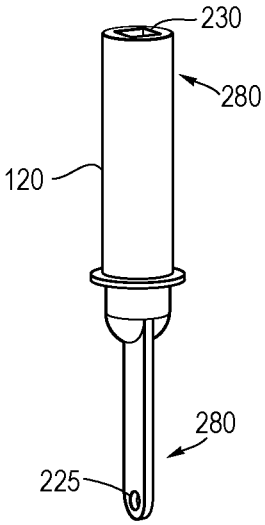
FIG. 14 is a side view of a second member of a training aid of an embodiment.
Figure 15:
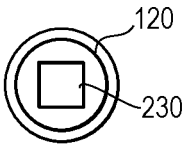
FIG. 15 is a top view of a second member of a training aid of an embodiment.

The training aid 100 also comprises a second member 120 that has a proximal end 280 (see FIG. 14) that is coupled the first member 110. As shown in FIGS. 10 and 13, in this embodiment, the proximal end 280 of the second member 120 has an opening 225 through which a quick-release pin 116 is placed through and secured by a screw 205. This structure serves as a quick-release vertical clamp. The second member 120 is rotatable about a second axis that passes through the opening 225. The first member 110 and the second member 120 comprise additional respective indicia 114, 122 to indicate a rotational position of the second member 120 about the second axis. Here, the indicia 114 on the vertical portion of the first member 110 includes lines with numbers that indicate a rotational position about the second axis (here, 90 degrees, but other angular ranges can be used), and indicia 122 on the second member 120 comprise an arrow that points to one of the lines. Of course, this is just one example, and other types of indicia can be used. With the quick-release pin 116, the user (e.g., a golf instructor) can quickly move and secure the second member 120 into a desired position.

In this embodiment, the distal end 280 of the second member 120 is configured to couple with the guide 130. As used herein, the phrase "coupled with" can mean directly coupled with or indirectly coupled with through one or more components. For example, in this embodiment, the second member 120 comprise a magnetic recess 230 that accepts an adaptor that attaches to the guide 130. In other embodiments, an adaptor is not needed, as the guide 130 couples directly with the second member 120.

Figure 16:
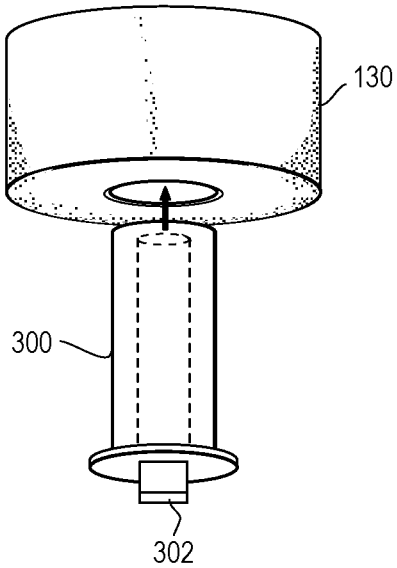
FIGS. 16-26 are illustrations of adaptors of an embodiment
Figure 17:
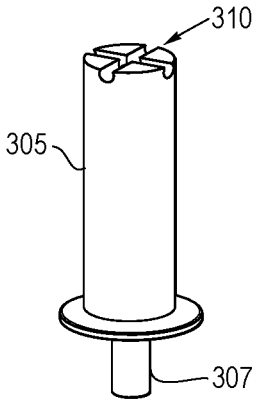
Figure 18:
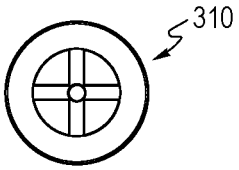
Figure 19:
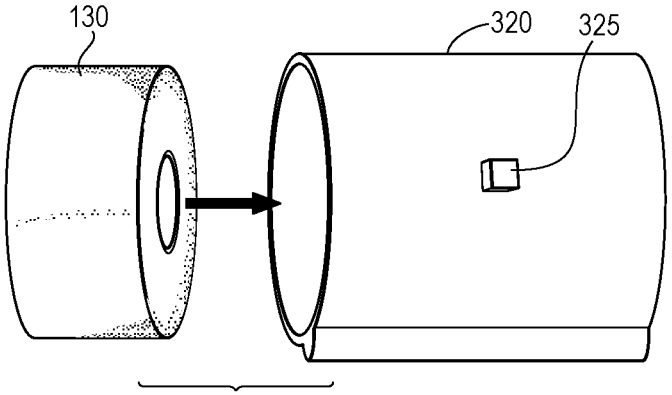
Figure 20:
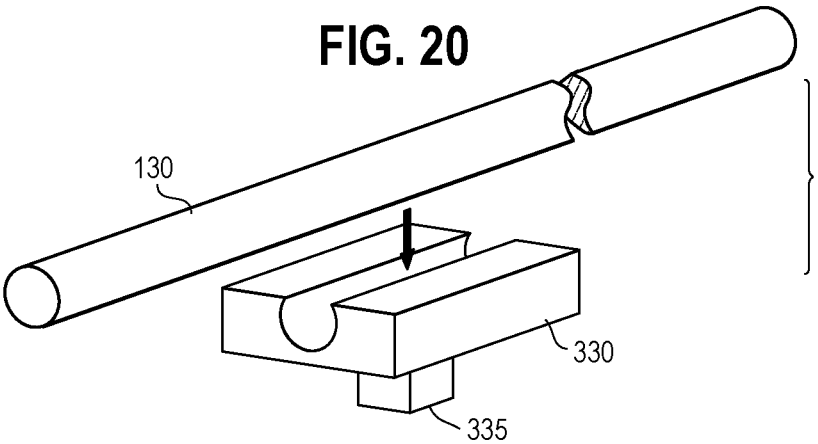

The adaptor can take form. For example, one end of the adaptor 300 in FIG. 16 comprises a cylinder that fits into the opening of a foam noodle, while the other end of the adaptor 300 comprises a protrusion 302 that fits in the mating recess 230 of the second member 120 (of course, the location of the protrusion and recess can be reversed). In another example shown in FIGS. 17 and 18, the top 310 of the adaptor 305 has one or more indentations for a rigid alignment stick to slide or snap into (the bottom of the adaptor 305 has a protrusion 307 to couple with the second member 120). That way, the adaptor 305 can be used with both an alignment stick and a foam noodle. Additionally, the center of the top 310 has an opening sized to accept an alignment stick. As other examples, the adaptor 320 in FIG. 19 has an open cylinder for accepting a foam noodle. This positions the foam noodle in more of a horizontal position that is parallel to the golfer rather than a protrusion position, which can be useful to help the golfer with alignment. The adaptor 330 in FIG. 20, which can be durable rubber, has a semi-circular opening for an alignment stick to snap or slide into. Both adaptors 320, 330 have protrusions 325, 355 for coupling with the second member 120.

Figure 21:
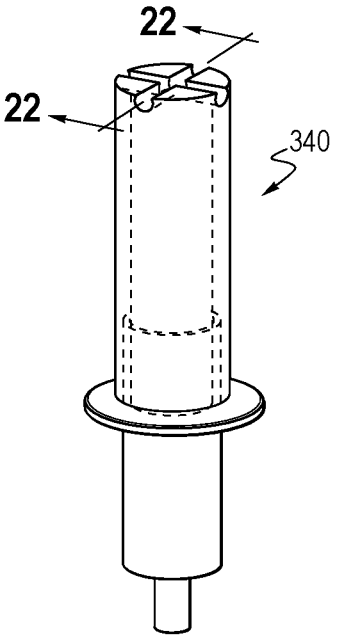
Figure 22:
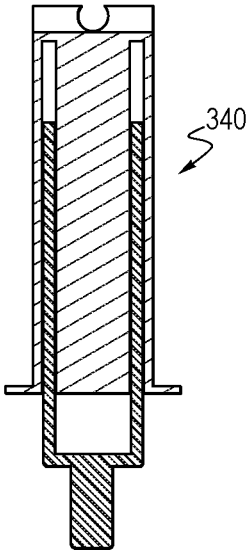
Figure 23:
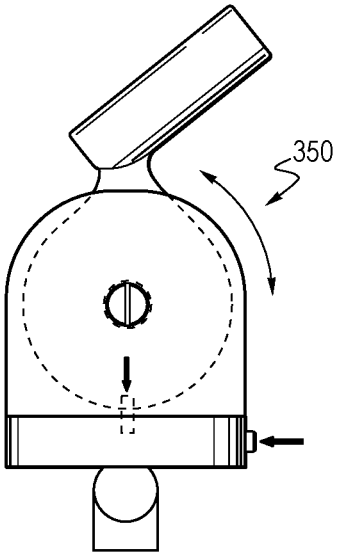
Figure 24:
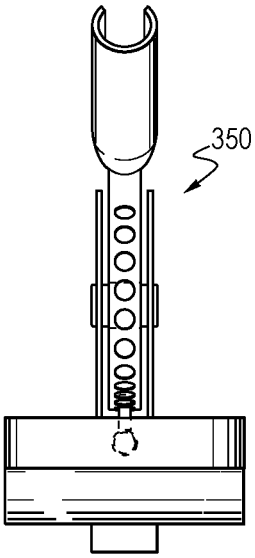
Figure 25:
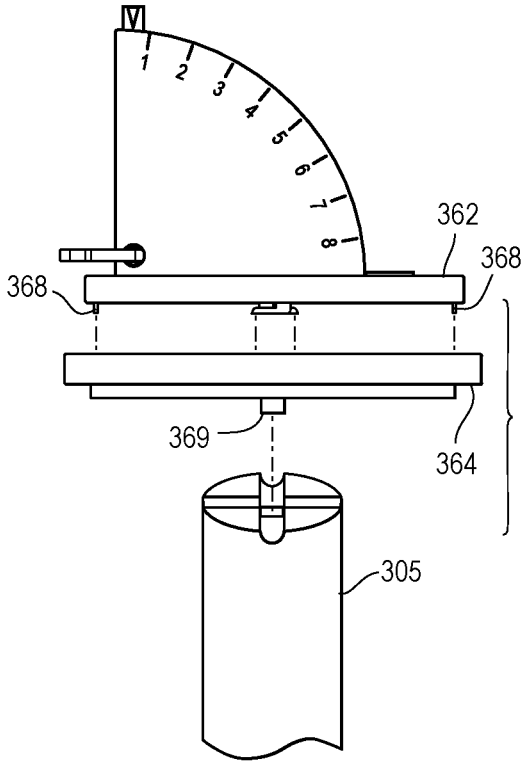
Figure 26:
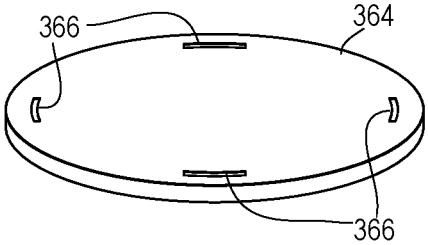

Other adaptors can be used. For example, the adaptor 340 shown in FIGS. 21 and 22 has a telescoping mechanism that allows a guide (e.g., foam noodle or alignment stick) to extend outward (e.g., 2-3 times farther away from the golfer's body) to allow for additional drills. As with the adaptor 305 in FIG. 17, this adaptor 340 has one or more indentations for a rigid alignment stick to slide or snap into, so the adaptor 340 can be used with both an alignment stick and a foam noodle. As another example, the adaptor 350 in FIGS. 23 and 24 contain a mechanism that allows the guide attached to the end of the adaptor to be angled in a variety of positions, which also allows for additional drills. In this particular implementation, the mechanism includes a notched wheel with a quick-release mechanism that allows a user to quickly set a vertical angle in addition to the one set on the training aid 100. Other mechanisms can be used. For example, FIG. 25 shows another version of the training aid 362 being attached to the adaptor 305 to provide for the additional vertical angle. As shown in FIGS. 25 and 26, this second training aid 362 can be secured to the adaptor 305 via a plate 364 that has slots 366 to accept protrusions 364 on the second training aid 362. The bottom of the plate 364 has a protrusion 369 to secure to the mating opening of the adaptor 305.

Figure 28:
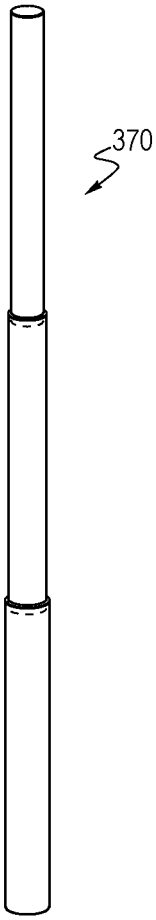
FIGS. 27 and 28 are illustrations of a telescoping guide of an embodiment.
Figure 29:
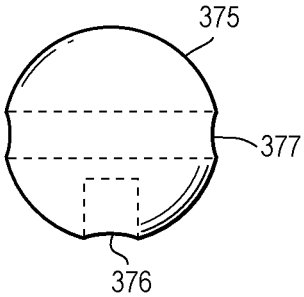
FIG. 29 is an illustration of an end cap of a telescoping guide of an embodiment.
Figure 27:
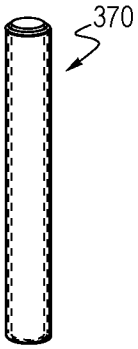

Adaptors can take other forms. For example, FIGS. 27-28 show a telescoping alignment rod 370 with an adaptor/stopper-endcap 375 for placement at the top of the alignment rod 370. In this example, the largest segment of the alignment rod 370 has the same circumference as a traditional alignment stick and can fit into the portions of the adaptors described above that can accept alignment sticks. When telescoped out, this alignment rod 370 can have the same length (or even be longer) than a traditional alignment stick (e.g., 30 inches, three-to-four feet, etc.). However, by being collapsible (e.g., to six inches up to two feet), the shorter length of the alignment rod 370 allows it to be used for drills requiring a shorter indicator. Further, the end cap 375 has an opening 376 that is attachable to the end of the alignment rod 370 to serve both as a safety feature and as another adaptor. More specifically, in this embodiment, the circumference of the end cap 375 is sized to fit inside a foam noodle. Also, the end cap 365 contains a slot 377 through which an alignment stick can pass through and serve as an indicator. As yet another example, any of the adaptors discussed above or other implementations of an adaptor can include an integrated or removable attachment for a laser pointer, which would allow certain body position to be indicated through where the laser is pointed.

Returning to FIG. 10, the first member 110 also has a quick-release mechanism. More specifically, the base 105 comprises an opening 210 through which a spring 215-biased pin 220 is inserted. The pin 220 fits through the opening 210 in the base 105 and into one of the plurality of notches/opening 113 around the circumference of the first member 110, which fits inside the inner portion of the base 105. This structure serves as a quick-release, spring-loaded, rotational lock.

As mentioned above, the base 105 of the training aid 100 can be integrated with or removably attached to a mount 140 in any suitable way, and various securing mechanisms can be used to secure the training aid 100 to the golfer. The following paragraphs provide examples of several implementations. It should be understood that these are merely examples and other implementations can be used.

Figure 30:
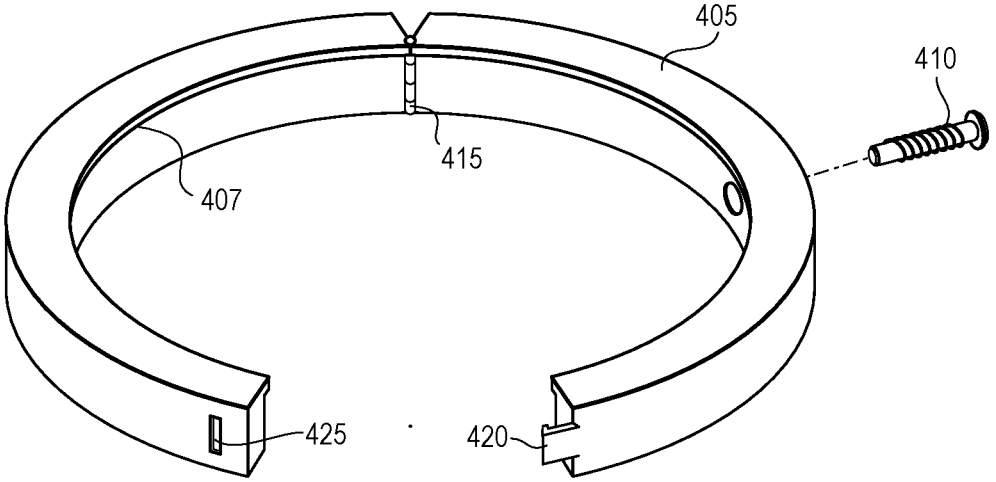
FIG. 30 is an illustration of a hinged base of an embodiment.

In one implementation, shown in FIG. 30, the base 405 has an inner ridge 407 to hold the first member 110 in place as an additional securing mechanism to the spring pin 410. The inner ridge 407 would accept a track that is built into the mount. The base 405 has a hinge point 415 that allows the base 405 to swing open and be placed over the track. The base 405 would then be hinged closed over the track, and clips 420, 425 on the ends of the base 405 would secure to each other, locking the base 400 into place around the tracks of the mount. Also, the pivoting side of the base 405 can have a bolt or other securing mechanism to hold the hinges in place and secure that portion of the base 405 to the mount.

Figure 31:
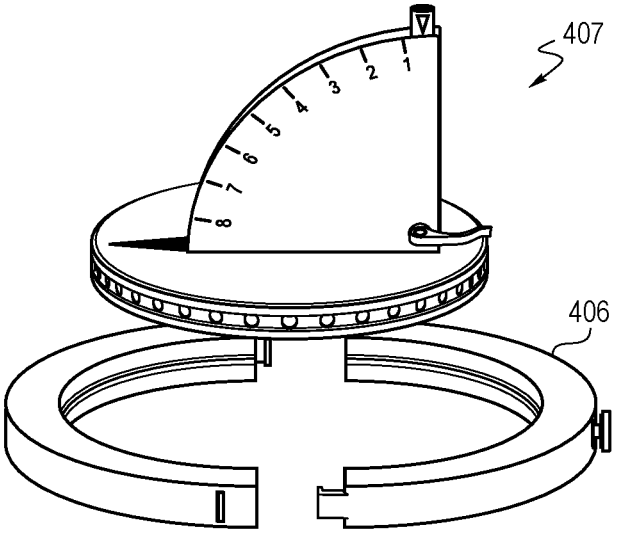
FIG. 31 is an illustration of a segmented base of an embodiment.

Instead of using a hinged base 405 as in FIG. 30, a base 406 with two or more segments (see FIG. 31) can be used. In this embodiment, the two segments can slide along tracks in the mount. In operation, the "sundial" portion of the training aid would be positioned inside the base 406, aligning with the interior grooves in the base 406. Then, the two segments of the base 406 would be pushed together and secured by the mating clasps on the two segments. This would lock with "sundial" portion into the base 407.

Figure 32:
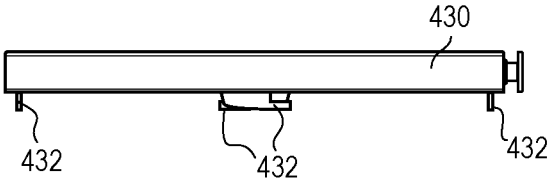
FIGS. 32-33 are illustrations of a removable base of an embodiment.
Figure 33:
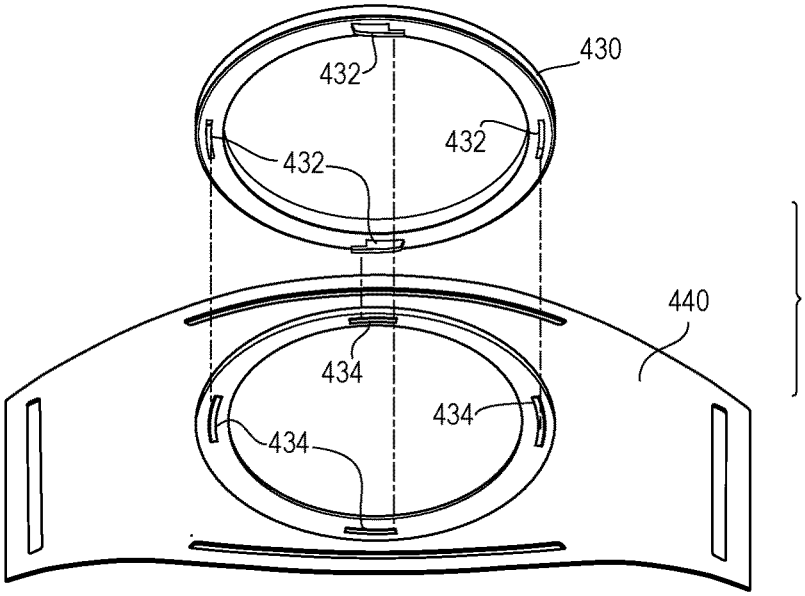

In another alternative shown in FIGS. 32 and 33, the underside of the base 430 comprises a plurality of ridges 432 to lock into corresponding openings 434 in the mount 440. To secure the base 430 to the mount 440, the user would place the base 430 onto the mount 440, such that the ridges 432 fit into the openings 434, and then twist the base 430 to lock it into place (e.g., with a one-quarter turn). In this and other embodiments, the first member can be separate from or integrated with the base 430.

Figure 34:
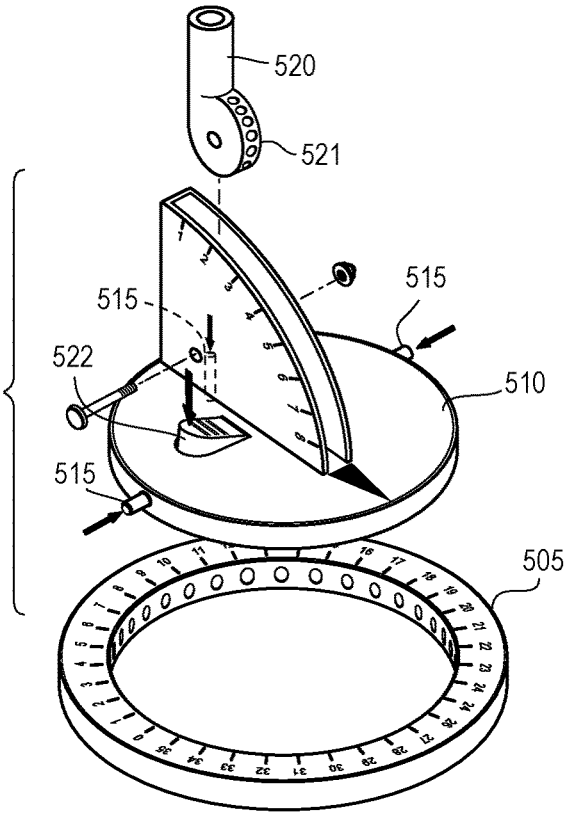
FIG. 34 is an illustration of a training aid of an embodiment having a first member with a quick-release button.

In yet another embodiment shown in FIG. 34, the base 505 (not the first member 510) contains the notches through which spring-loaded securing pins 515 fits. Another spring-loaded pin 515 secures the position of the second member 520 by fitting into one of the notches on the rotary portion 521 of the first member 530. In this embodiment, the first member 510 contains a button 522 that, when pushed, retracts all three spring-loaded pins 515. In this way, both the first member 510 and the second member 520 lock and unlock together using a quick-release mechanism. In this example, the base 505 is affixed to a mount, but other securing mechanisms can be used.

Any suitable mount can be used to place the training aid on a golfer. The following paragraph provide examples of various mounts that be used with a body strap to secure the mount on a body part of the golfer (e.g., torso, arm, leg, etc.). It should be noted that other mounts can be used, such as those that clip or otherwise secure to an article of clothing (e.g., belt, pants, hat, etc.) of the golfer. So, like the other details presented herein, the details of the mount should not be read into the claims unless expressly recited therein.

Figure 35:
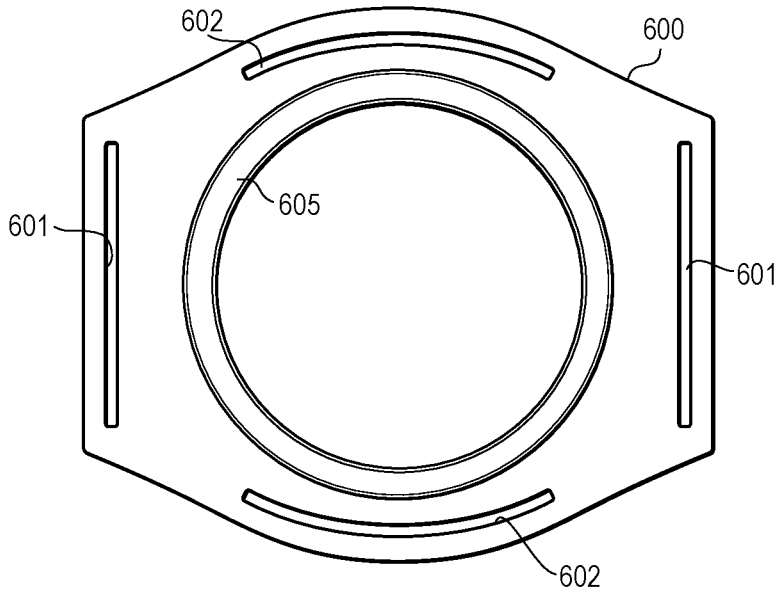
FIGS. 35 and 36 are illustrations of a mount of an embodiment.
Figure 36:
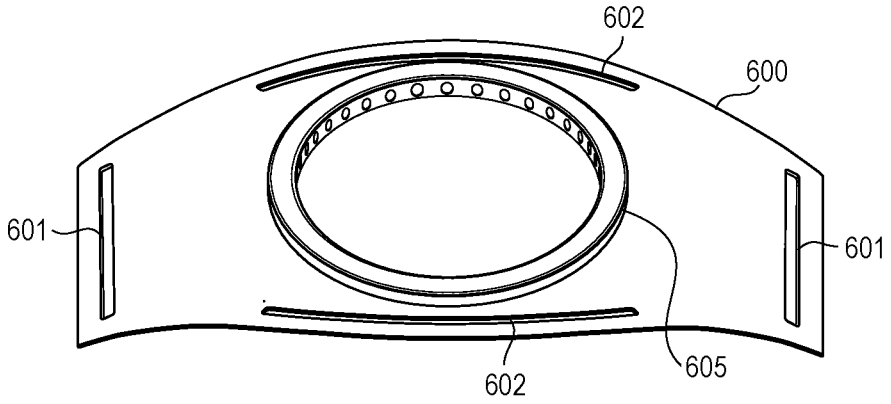
Figure 37:
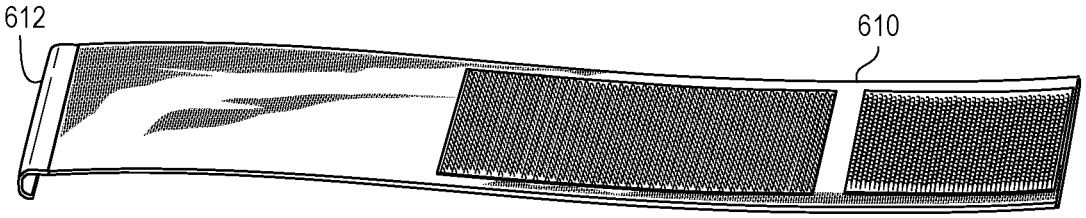
FIGS. 37 and 38 are illustrations of straps of an embodiment.
Figure 38:
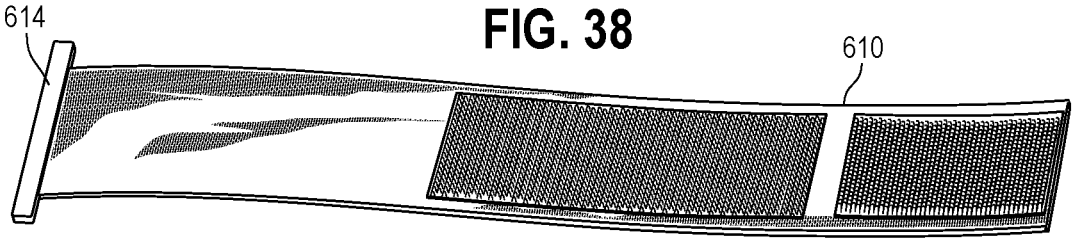

Returning to the drawings, the mount 600 shown in FIGS. 35 and 36 has a first and second 601, 602 pairs of strap openings, one or both of which can be used with securing straps. The mount 600 also has the base 605 integrated in it, although, in other embodiments, the base 605 is removable. As shown in FIGS. 37 and 38, the elastic securing straps 610 can be Velcro straps that slide through the openings 601, 602 of the mount 600. The end of the securing strap can have a hook 612 (FIG. 37) or hard stopper 614 (FIG. 38) to secure the end to the mount 600 and prevent the strap 610 from slipping through the openings 601, 602. The other end of the strap 610 can loop through the opposite opening and secure to itself with the Velcro.

Figure 39:
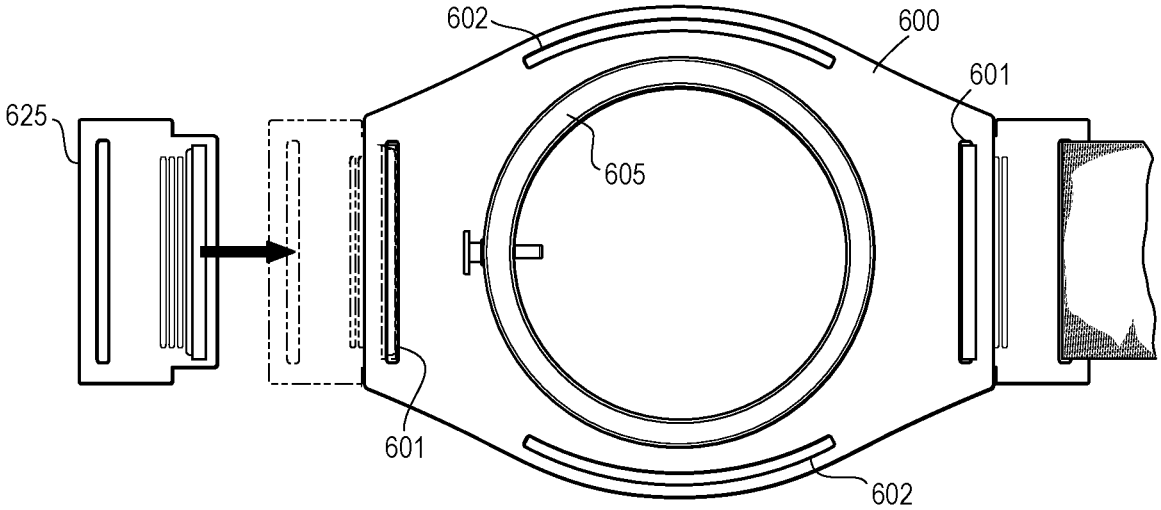
FIG. 39 is an illustration of a mount and link of an embodiment.
Figure 40:
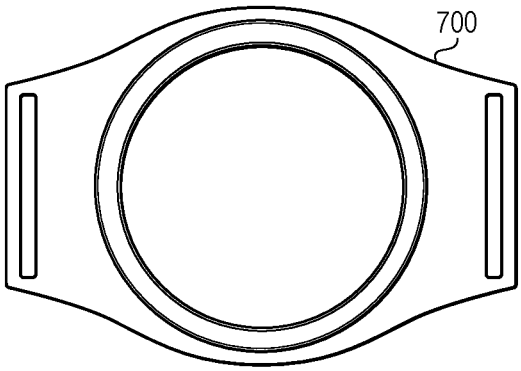
FIGS. 40-42 are illustrations of different-shaped mounts of an embodiment.
Figure 41:
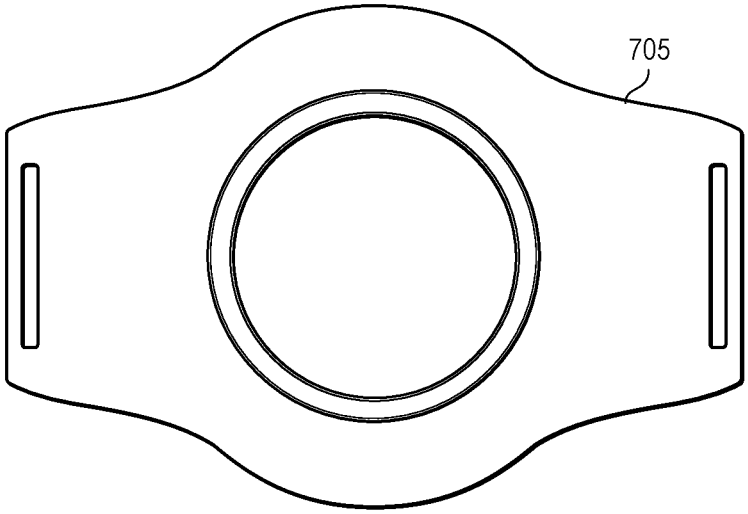
Figure 42:
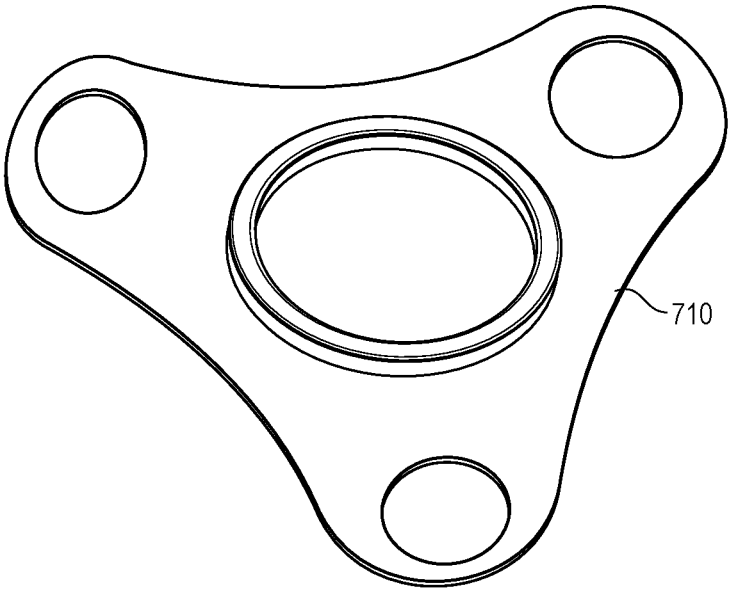
Figure 43:
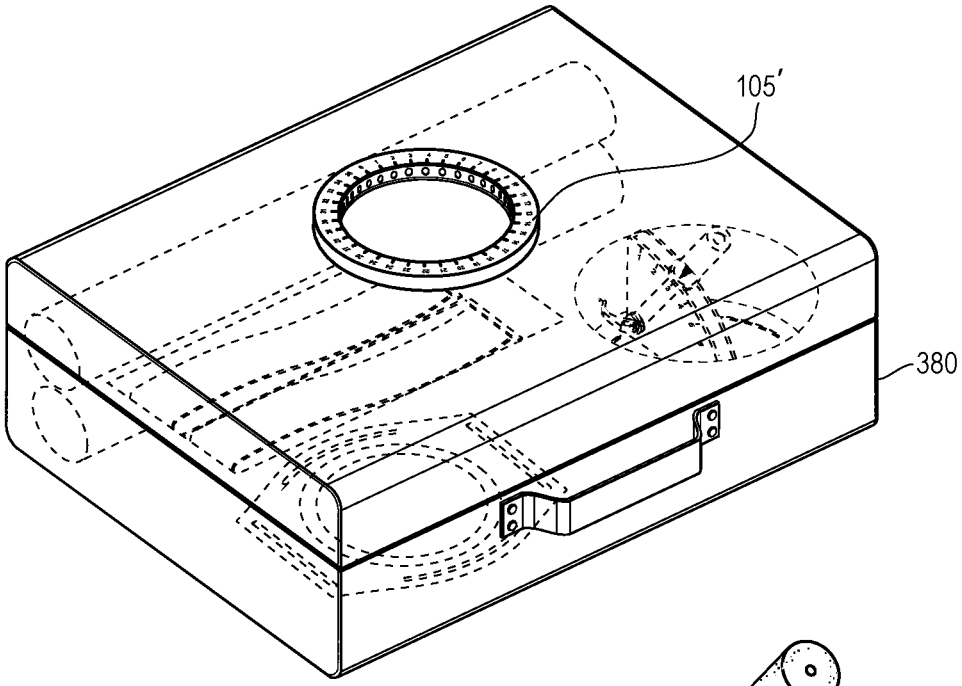
FIGS. 43 and 44 are illustrations of a case of an embodiment.
Figure 44:
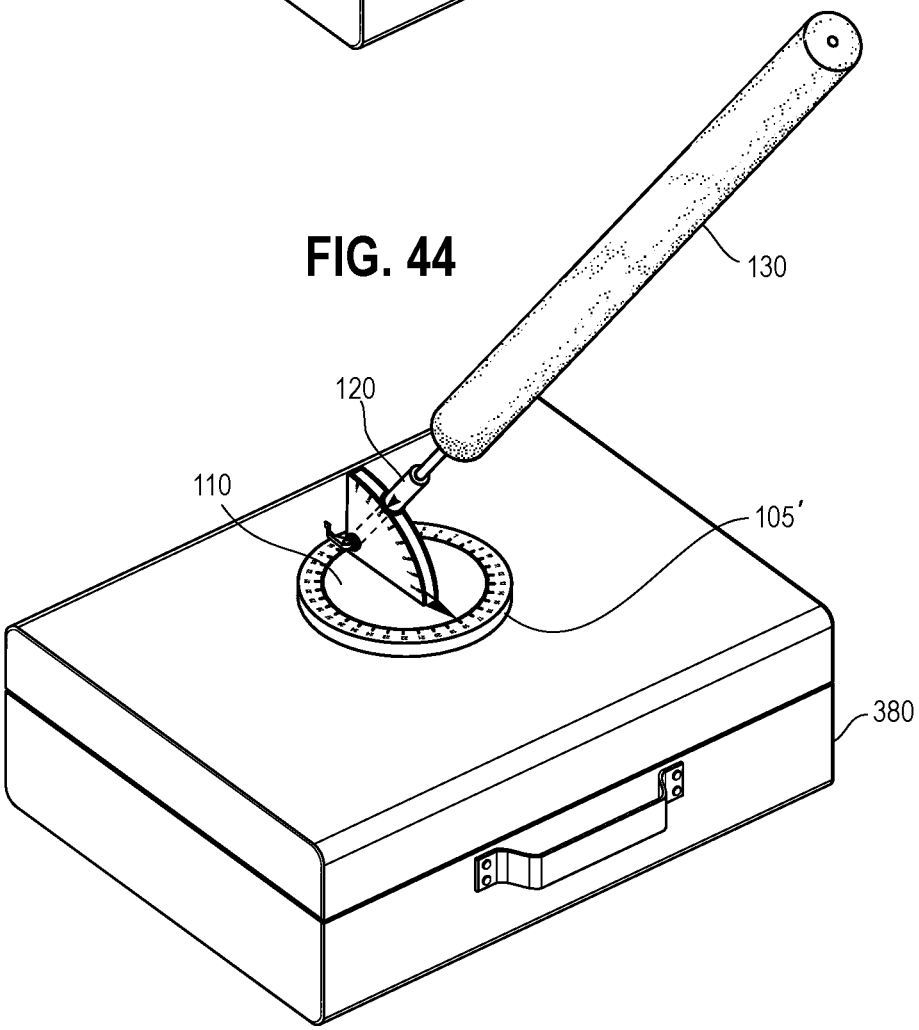
Figure 45:
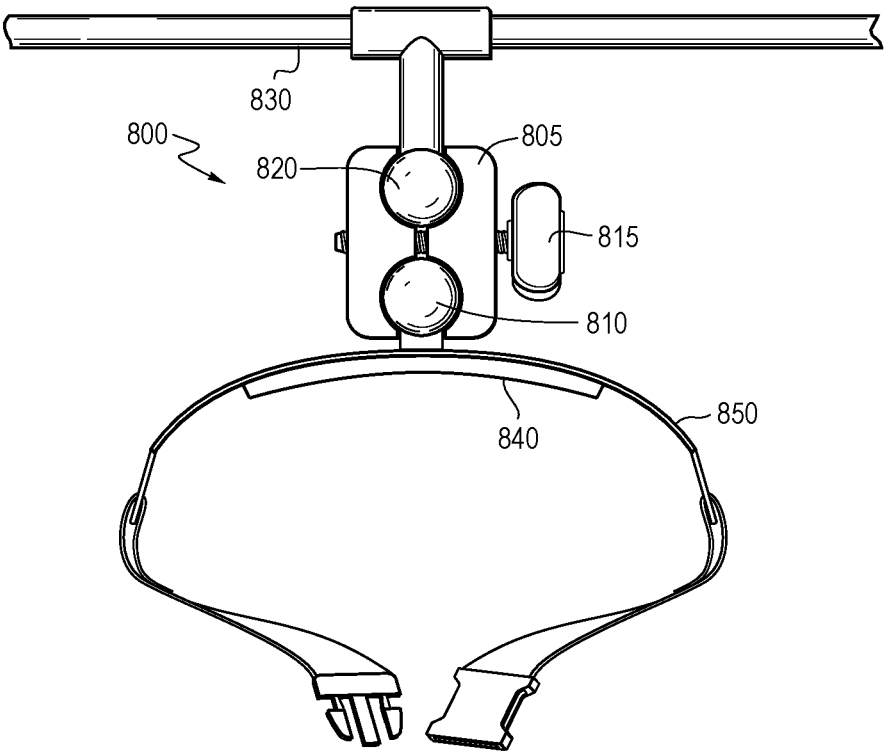
FIG. 45 is an illustration of a training aid of an embodiment.
Figure 46:
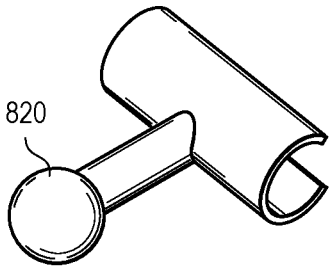
FIGS. 46 and 47 are illustrations of a second member of an embodiment.
Figure 47:
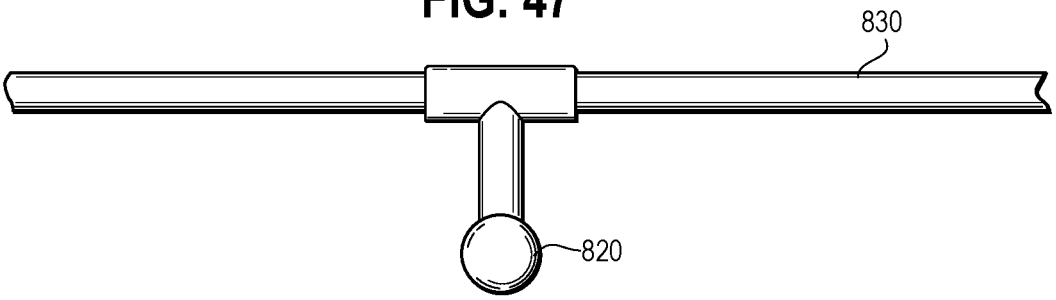
Figure 48:
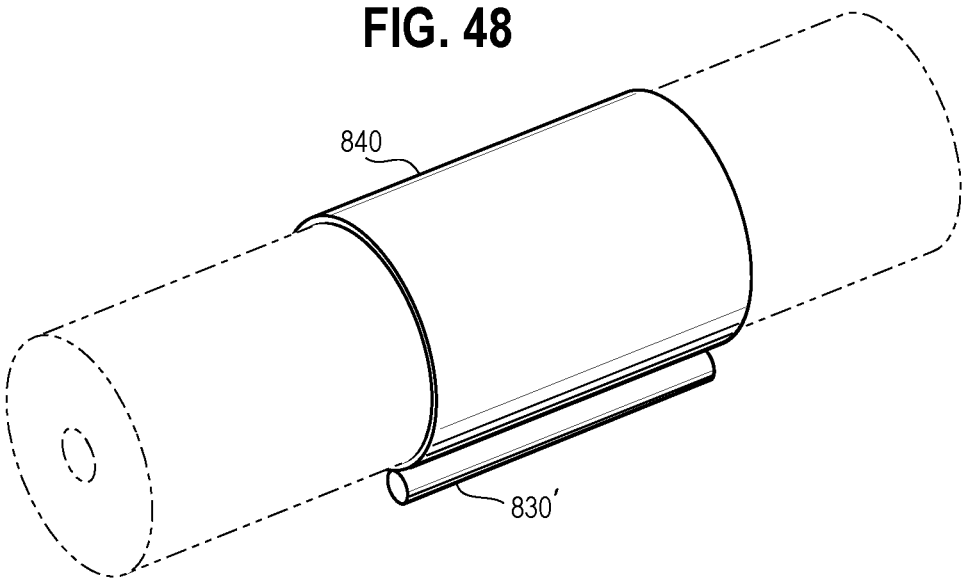
FIG. 48 is an illustration of an adaptor of an embodiment.

To make the mount 600 more versatile to different body parts and shapes, links 625 (see FIG. 39) can be secured to the mount 600 (e.g., via clips or hooks) to extend and expand the mount 600. This provides versatility to the mount 600, such that it can be small enough to fit the wrist or small arm, yet large enough to fit larger limbs or circumferences. As another way to provide versatility, small and medium-sized mounts 700, 705 (see FIGS. 40 and 41) can be provided. Further, a larger mount 710 (see FIG. 42) of a different shape can be used to fit different body parts (e.g., hip, torso, shoulder, thigh, etc.). This mount 710 has holes for different strapping options.

Also, for the ease of the instructor, a carrying case 380 (see FIGS. 21 and 22) can be provided to hold one or more versions of the training aid, mount, straps, guide, and/or other items. In this embodiment, the top of the case comprises a secondary base 105', which is identical to the base 105 of the training aid 100 but is integrated into the case 380. The first and second member 110, 120 can be assembled on the case 380. This allows the instructor to set the case 380 on the ground near the golfer, so the guide 130 would project from the case 380 instead of from the golfer to allow for different types of drills.

As illustrated by the above examples, the training aid 100 of these embodiments provides a 360-degree rotatable/quick-release-locking base in conjunction with a 90-degree lockable pivot, each of with indicia to indicate the two rotational positions. That way, when an instructor positions the first and second member 110, 120 in the proper positions, the instructor can make note of the horizontal and vertical rotational positions. At the next lesson, the instructor can simple "dial in" the noted horizontal and vertical rotational positions rather than "reinvent the wheel" by determining the proper position for the golfer. The training aid 100 can be used as a body movement adapter for guides, such as foam noodles or alignment sticks. The training aid can be connected to virtually any part of the body (e.g., torso, shoulder, pelvis, back, thigh, arm, shin, etc.) and locked into any angle. This offers coaches the freedom to customize specific drills based on the individual student rather than put them into a "one-size-fits-all" device. The training aid 100 can be used to indicate virtually an unlimited amount of movements and positions to be achieved and can also help create a better tempo between body, arms, and club.

As noted above, the examples presented herein describe merely some example implementations. Many alternatives are possible. For example, the various details mentioned above can be "mixed and matched" with each other. Also, other variations are possible. For example, instead of the training aid being in the shape of a sundial, the training aid 800 can have a rotatable ball joint configuration, as in FIGS. 45-50.

Figure 49:
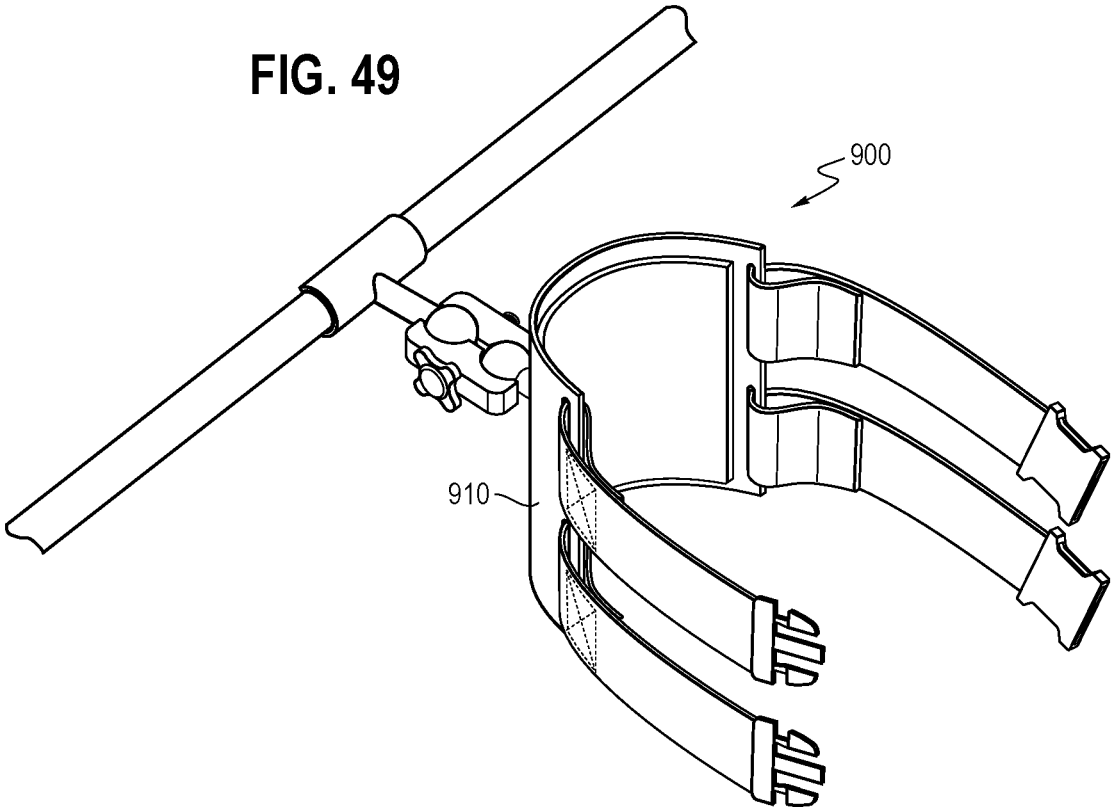
FIGS. 49 and 50 are illustrations of a training aid of an embodiment.
Figure 50:
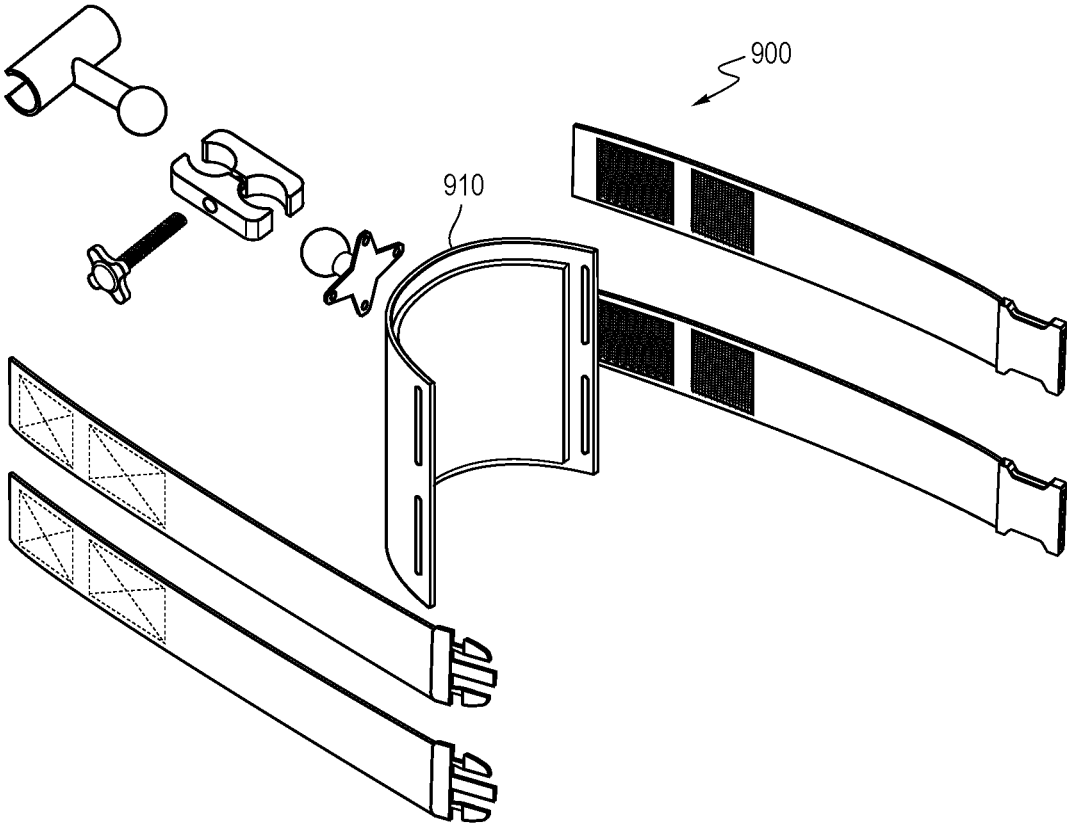

As shown in those drawings, the training aid 800 in that embodiment comprises a base 805, which is two opposing structures that lock in place a ball joint of a first member 810 and a ball joint of a second member 820 by turning a knob 815 (e.g., a swivel lock/tightener). Here, the second member 820 includes an integrated receptacle for a guide 830, although adaptors can be used (such as the adaptor 840 in FIG. 48 for a foam noodle, which has a portion 830' having the same circumference as an alignment stick to fit in the receptacle of the second member 820). Also, the first member 810 has a mount 840 integrated therein that fits to a body of a golfer. Straps 850 are used to secure the training aid 800 to the golfer. The base 805, first member 810, and/or second member 820 can have indicia showing the rotational position of one or both of the ball joints. Other configurations are possible. For example, as shown in FIGS. 49 and 50, the training aid 900 can have a larger mount 910 for fitting on an arm or shin.

In summary, the training aids shown in FIGS. 45-50 can be used to convert alignment sticks into a body movement/position indicating rod via a pivoting clamp that is attached to a body part harness or a club mount. Any desired indicating utensil can be used, and the clamp can be versatile enough to secure anything from an alignment stick to a golf club to a foam pool noodle, for example. This may involve multiple size clips with pivoting ends or one adjustable pivoting clamp. As such, this device allows an alignment stick, pool noodle, etc. to be connected to almost any part of the body and or club.

A clip can be sized for an alignment stick or pool noodle to firmly clip into and remain snug enough to be secure, yet still be able to slide to a preferred lateral placement with deliberate force. Instead of a clip, a clamp can be used to adjust for a range of indicators with various circumferences. The other end of the clamp or clip can be a pivoting ball joint that fits in an adjustable/lockable 360-degree swivel. This training aid can come as an all-in-one kit or as a la carte options for various-sized harnesses to accommodate different parts of the body and golf club mount (e.g., an arm harness, torso harness, or hip and shoulder harness). Harnesses can include the other half of the pivoting agent components that work with the clip and/or clamp.

Alignment stick/pool noodle/other indicator stickers can be used to help indicate certain drills and positions. Also, there can be additional retractable/lockable cables connected to certain harnesses that could attach to and offer an additional support structure for the connected alignment stick, and/or provide additional drills (e.g., a connecting cable retracted from the lead shoulder harness to the end of the grip, locking whatever that length is, to help train and offer feedback to maintain a straight lead arm in the backswing all the way through impact). Also, there can be an additional camera mounting option to allow for body cam feedback of arms, hands, and/or club relative to the attached alignment sticks. Further, there can be a book and/or app illustrating all the various drills already discovered. Finally, the ball/pivot end of the clip-in receiver/clamp can be a universal size for different body straps and can be interchangeable between them It is intended that the foregoing detailed description be understood as an illustration of selected forms that the invention can take and not as a definition of the invention. It is only the following claims, including all equivalents, which are intended to define the scope of the claimed invention. Finally, it should be noted that any aspect of any of the embodiments described herein can be used alone or in combination with one another.

What is claimed is:

1. A training aid comprising:

a base, wherein the base is hinged;

a first member rotatable with respect to the base about a first axis, wherein the base and the first member comprise respective indicia indicating a rotational position of the first member about the first axis; and a second member comprising:

a proximal end coupled with the first member and rotatable about a second axis, wherein the first member and the second member comprise additional respective indicia to indicate a rotational position of the second member about the second axis; and a distal end configured to couple with a guide.

2. A training aid comprising:

a base, wherein the base comprises latches that secure onto a mount;

a first member rotatable with respect to the base about a first axis, wherein the base and the first member comprise respective indicia indicating a rotational position of the first member about the first axis; and a second member comprising:

a proximal end coupled with the first member and rotatable about a second axis, wherein the first member and the second member comprise additional respective indicia to indicate a rotational position of the second member about the second axis; and a distal end configured to couple with a guide.

3. A training aid comprising:

a mount comprising at least one opening sized to receive a strap;

a base coupled with the mount;

a first member positioned in the base and rotatable 360 degrees about a first axis through a center of the first member, wherein the base and the first member comprise horizontal rotational indicators;

a second member comprising:

a proximal end coupled with the first member and rotatable 90 degrees about a second axis that is perpendicular to the first axis, wherein the first member and the second member comprise vertical rotational indicators; and a distal end configured to couple with a guide;

a plurality of releasable pins positioned to secure the first member with respect to the base and to secure the second member with respect to the first member; and a quick-release button configured to, when pressed, simultaneously release the plurality of releasable pins to allow rotation of the first and second members.

4. The training aid of claim 3, wherein the first member is sundial shaped.

5. The training aid of claim 3, wherein one of the base and the first member comprises a plurality of notches, each sized to accept at least one of the plurality of releasable pins.

6. The training aid of claim 3, wherein one of the first member and the second member comprises a plurality of notches, each sized to accept at least one of the plurality of releasable pins.

* * * * *